US010130180B2

(12) United States Patent
Frankel et al.

(10) Patent No.: US 10,130,180 B2
(45) Date of Patent: Nov. 20, 2018

(54) COLLAPSIBLE FOLDING CHAIR

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 202 days.

(21) Appl. No.: 15/290,027

(22) Filed: Oct. 11, 2016

(65) Prior Publication Data

US 2018/0098632 A1 Apr. 12, 2018

(51) Int. Cl.
*A47C 4/28* (2006.01)
*A47C 4/02* (2006.01)

(52) U.S. Cl.
CPC . *A47C 4/28* (2013.01); *A47C 4/02* (2013.01)

(58) Field of Classification Search
CPC ..... A47C 4/42; A47C 4/28
See application file for complete search history.

(56) References Cited

U.S. PATENT DOCUMENTS 2,689,602 A * 9/1954 Morgan ..... A47C 3/12 297/299
7,011,372 B1 * 3/2006 Hsieh ..... A47C 4/02 297/16.1
7,404,601 B2 * 7/2008 Chen ..... A47C 4/44 297/16.1
D710,138 S * 8/2014 Wu ..... D6/716
D710,639 S * 8/2014 Wu ..... D6/716
D769,010 S * 10/2016 Frankel ..... D6/368
2014/0346817 A1 * 11/2014 Tseng ..... A47C 4/44 297/16.1

FOREIGN PATENT DOCUMENTS

DE 338977 C * 7/1921 ..... A47C 4/42

* cited by examiner

*Primary Examiner* — David E Allred
(74) *Attorney, Agent, or Firm* — Merek, Blackmon & Voorhees, LLC

(57) ABSTRACT

A folding collapsible chair includes a seat ring and folding legs with a back rest fabric installed over the seat ring. The seat ring has four positioning pieces that have downward facing sheath tubes; each sheath tube has a locking structure. The folding legs include four support rods and two horizontal bars. The four support rods correspond with the four positioning pieces. Two diagonal support rods form a unit, fixed together with a horizontal bar to form one body. Two of the aforementioned units, each of which incorporates two support rods with a horizontal bar, are cross-hinged together so that they can pull together when folded up for storage with the seat ring. The aforementioned seat ring is linked together into a locking structure with the top ends of the four support rods by means of the positioning pieces' sheath tubes.

12 Claims, 9 Drawing Sheets

COLLAPSIBLE FOLDING CHAIR

BACKGROUND OF THE INVENTION

Field of the Invention

The present application relates to a new model in the furniture field, namely a type of folding, collapsible chair involving a kind of seat ring with folding legs that collapse.

Technical Background

Currently, existing round folding chairs, commonly called "moon chairs" or "radar chairs," are produced with soft fabric and rod materials, with the front face of a seat forming a round shape like that of a radar antenna. From the side, the seat also resembles a moon shape, and thus this is also called a "moon chair." The structure is simple; the shape is elegant and quite popular. As FIG. 1 shows, the structure includes a round seat ring 1, with a seat fabric 2 laid over the seat ring. There are front and back support rods 3 and 4 that support the seat ring 1 at two points each. After the front and back support rods link, the top ends of each support rod link on to the seat ring. The rear support rod 4 links with a sheath 5. The front support rod 3 passes through this sheath 5, forming the active link structure between front and rear support rods 3 and 4. A stopper block 6 is installed on support rod 3 such that when the round chair is opened, the sheath receives support and provides weight-bearing stability. This round folding chair's overall structure is simple, and the shape is noteworthy for that simplicity. However, the round folding chair also has a drawback. It is only suitable in principle for medium or small-sized chairs, and, as it happens, this type of folding chair's seat ring 1 is oriented towards the back of the structure such that it is only suitable for short-term use. It cannot provide support for the shoulders and head of a user. To this end, if the seat ring 1 were enlarged, it could provide support for a user's head. However, the X-crossing formed by the front and back support rods 3 and 4 would also need to be capable of bearing a heavier load. This would require using support rods of a larger bore to obtain the necessary support, causing the weight of the product to increase, which would be its own problem. How can the existing insufficiencies of this kind of folding chair be improved so that the seat ring can be enlarged and we can ensure weight-bearing stability? That is an object of the research done for this invention.

SUMMARY OF THE INVENTION

This invention was produced with the intention of designing a type of collapsible folding chair whose seat ring is supported by four vertical support rods and folding legs that are in a distributed structure about the seat ring.

The technical proposal for this invention is realized in the following way: a type of collapsible folding chair, including a seat ring and folding legs, has a back rest fabric installed over the seat ring. The characteristics of this design are that a seat ring has four positioning pieces, and the positioning pieces have downward-facing sheath tubes, and the sheath tubes have a locking structure. The folding legs include four support rods and two horizontal bars. The four support rods correspond with the four positioning pieces with downward-facing sheath tubes. Two diagonal support rods form a unit, fixed together with one of the horizontal bars to form one body. Two of the aforementioned units, each of which incorporates two support rods with a horizontal bar, are cross-hinged together so that they can pull together when folded up. Additionally, the above-mentioned seat ring has positioning pieces with sheath tubes that are sheathed on to the top ends of the four support rods, and are linked together with the locking structure.

The aforementioned support rods and horizontal bars could be fixed together using one of the following three structural options: 1.) The two ends of the horizontal bars have curved segments, and these curved segments are pressed against the support rods, and are riveted in place with two rivets; 2.) The two ends of the horizontal bar are welded on to the support rods; or 3.) The horizontal bar and support rods are a single rod that is bent into shape.

The aforementioned positioning piece forms a T-shaped structure, vertically, with a downward sheath tube, and has horizontal brackets that support the seat ring. The seat ring is riveted to these brackets.

The aforementioned positioning piece brackets have also been configured with a brace, and the brace covers the seat ring that is bracketed by the positioning piece. The rivets pass through the brace, seat ring, and brackets, such that the three are riveted together.

The aforementioned seat ring could be formed using one of the following structures or shapes: circular; oval; rectangular; triangular; pentagonal; hexagonal; octagonal; trapezoidal; calabash-shaped; rounded top, or squared bottom bread loaf-shaped. The seat ring is a preferably closed structure.

The aforementioned seat ring's closed seams are located at the positioning pieces' brackets, and is connected with the brace by riveting with the bracket.

The aforementioned seat fabric could be formed using one of the following structures: Oxford cloth stitched into the seat; an elastic cord planar weaved structure; an elastic string planar structure with weaved section; or an elastic belt or elastic belt woven with Oxford cloth into the seating as a planar structure.

The aforementioned positioning piece's locking structure could be formed using one of the following structures: 1.) a connector bolt, with the bolt having a positioning piece and sheath tube, the end of the bolt facing the sheath tube center; or 2.) a spring lock, with said spring lock fixed within the positioning piece's sheath tube wall. The spring lock's end faces the sheath tube's center.

This invention incorporates a seat ring and folding legs using a collapsing structure as well as positioning pieces fixed to the seat ring and folding legs to form a locking connection. The structure receives direct support from the four support rods on the folding legs. This solves the previously described problem of needing larger bore support rods for the seat ring, such that the seat ring can support a user's head, providing the folding chair with leisure functionality without increasing the bore of support rods and the weight of the product.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings. Namely, in the drawings the following reference numbers refer to the following part.

1—seat ring
2—seating fabric
20—seat
21—elastic cord
22—elastic belt
3—front support rods
4—back support rods
5—sheath
6—stopper block
7—folding legs
71—support rods
711—grooved ring
72—horizontal bar
8—positioning piece
81—sheath tube
82—bracket
83—brace
84—locking structure
9—rivet

DETAILED DESCRIPTION OF THE PREFERRED EMBODIMENT(S)

Figure 4:
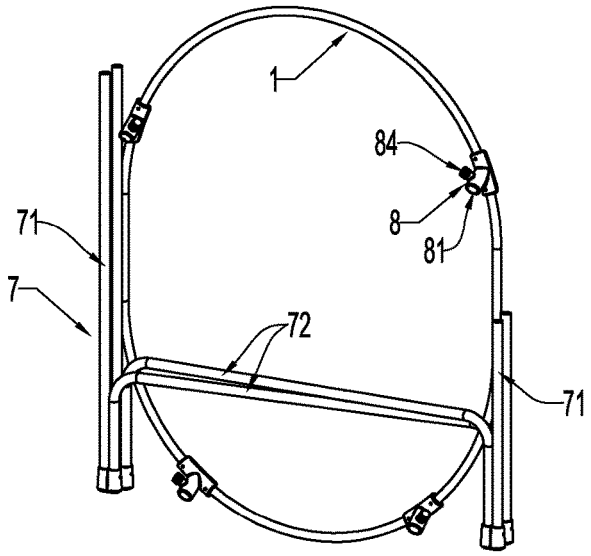
FIG. 4 shows a collapsible folding chair support frame folded state schematic diagram.
Figure 5:
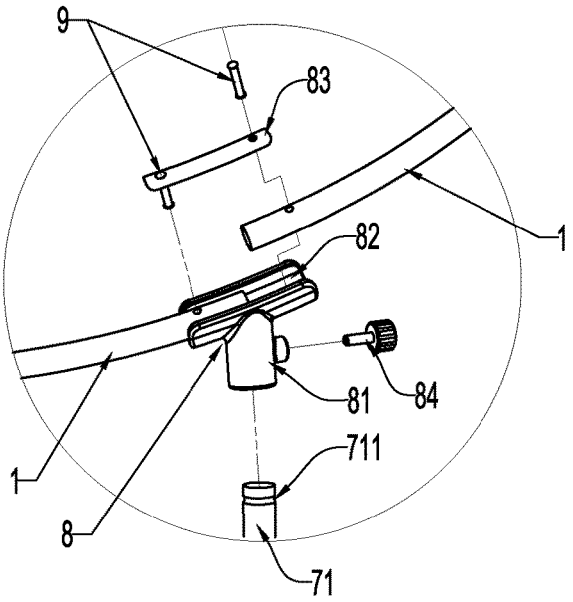
FIG. 5 shows a positioning piece and seat ring relationship with support rods diagram.

Referring now to FIGS. 2 through 5, a description of the preferred embodiment will be made. The collapsing folding chair includes a seat ring 1 and folding legs 7. The seat ring 1 has a seating fabric 2 positioned on it. Seat ring 1 is provided with four positioning pieces 8. Each positioning piece 8 has a downwards-facing sheath tube 81. Sheath tube 81 is provided with a locking structure 84. The positioning piece 8 forms a T-shaped structure, where the vertical part of this T-shaped structure is the downward-facing sheath tube 81, and the horizontal part of this T-shaped structure is bracket 82 that supports seat ring 1. The seat ring 1 is riveted to these brackets with rivets 9. Further, each positioning pieces' bracket 82 has also been configured with a brace 83, where the brace 83 covers the seat ring 1. The rivets 9 pass through the brace 83, the seat ring 1, and the bracket 82, riveting the three together. The seat ring 1 could be a single rod bent into shape, or it could be two or three connecting pieces joined into a circle. The seat ring's 1 seam is located at the positioning piece's 8 bracket position, thereby forming a connection with the brace 83 and bracket 82, such that the seat ring seams need not be welded or otherwise fixed, as shown in FIG. 5.

The folding legs 7 include four support rods 71 and two horizontal bars 72. The four support rods 71 correspond to four positioning pieces 8. Among these are two long support rods that connect with the seat ring, lifting the seat back and forming a reclined angle. There are also two short support rods located at the front of the chair. This facilitates seating and forms a support for the legs, jointly forming a shape for the seat ring that can support the front being low and the back being high. Two diagonal support rods 71 form a unit that is fixed together with a horizontal bar 72 to form one body. Two of the aforementioned units, each of which incorporates two support rods 71 with a horizontal bar 72, are cross-hinged together so that they can pull together when folded up for storage with the seat ring as shown in FIG. 4. When in use, the seat ring 1 uses the sheath tubes 81 of positioning pieces 8 to sheathe the top ends of the four support rods 71, locking them into place with the locking structure 84. The result is a complete folding chair that is a firm body and can be moved or positioned.

In the folding legs 7, the support rods 71 and horizontal bars 72 could be fixed together using one of the following structures: 1.) The two ends of the horizontal bars 72 have curved segments, and these curved segments are pressed against the support rods 71, and are riveted in place with rivets, as in FIGS. 2 and 3; 2.) the two ends of the horizontal bars 72 are welded on to the support rods 71; and 3.) the horizontal bar 72 and the two support rods 71 are a single rod that is bent into shape. In this third structure, the horizontal rods 72 would touch the ground or would be closer to the ground, which would weaken the stability of the folding chair.

Figure 6:
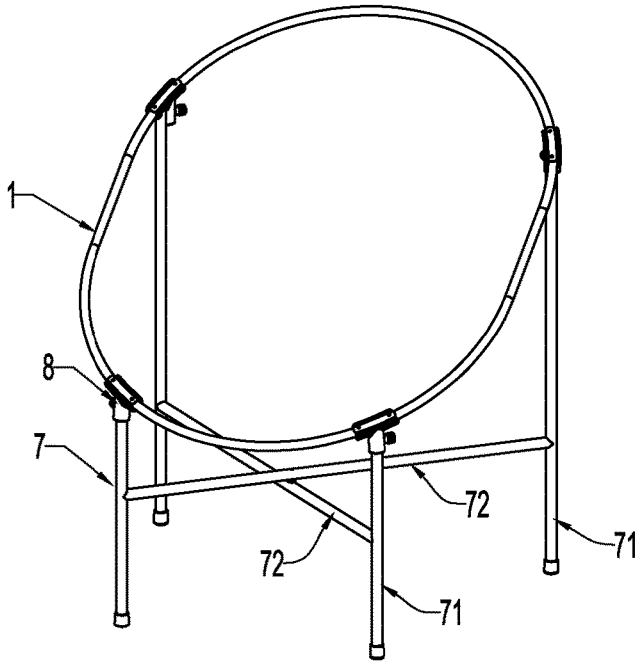
FIG. 6 shows a collapsible folding chair support frame 2D schematic diagram.

Referring now to FIG. 6, the folding legs 7 have a horizontal bar 72 which is directly welded to the support rods 71 on two ends. This version of horizontal rod 72 uses the fewest materials, and can thus reduce the load on the folding legs 7. Since the folding legs 7 will support the seat ring 1 at the front and back ends, the back two support rods 71 are of greater height than the two front supports rods 71, and the two horizontal bars 72 have welding points or connection points with the support rods. The welding points should be at the front support rods' 71 center section and the back section support rods' 71 lower middle section, since these points will be most suitable for maintaining the stability of the folding chair.

As in FIG. 5, the positioning piece's 8 locking structure 84 could have several configurations. Firstly, it could include a bolt, where the bolt is screwed into the positioning piece's sheath tube 81, with the bolt's end facing the sheath tube center. The sheath tubes 81 of positioning pieces 1 would serve to sheathe the ends of the support rods 71; the bolt that screws into the sheath tube 81 would prevent the support rod 71 from unintentionally falling out. To this end, the support rod 71 ends in a grooved ring 711, providing a reliable locking relationship. Secondly, the locking structure could be a spring lock, with said spring lock fixed in a positioning piece's sheath tube wall. The spring lock's end faces the sheath tube's center, and the spring lock would hold in place the end of a support rod 71 inserted into the sheath tube. The ends of support rods 71 in this case would still be configured with a grooved ring 711. The spring lock would have an automatic locking function, with limited locking force. In contrasting the two locking devices, the bolt is hand-operated, but the lock is more reliable.

Furthermore, the seat ring shape can be explained as follows: the seat ring can be formed by one to three rods, forming a closed structure in one of the following shapes: circular; oval; rectangular; triangular; pentagonal; hexagonal; octagonal; trapezoidal; calabash-shaped; rounded top, or squared bottom bread loaf-shaped. The seat ring is preferably a closed structure.

Figure 1:
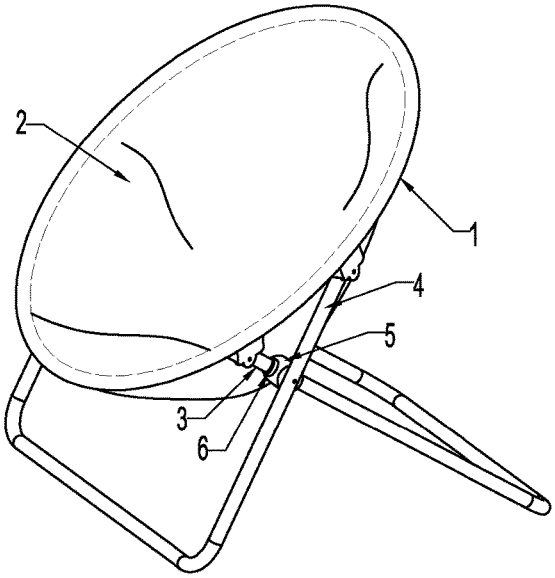
FIG. 1 shows a currently existing, prior art folding round chair 3D schematic diagram.
Figure 2:
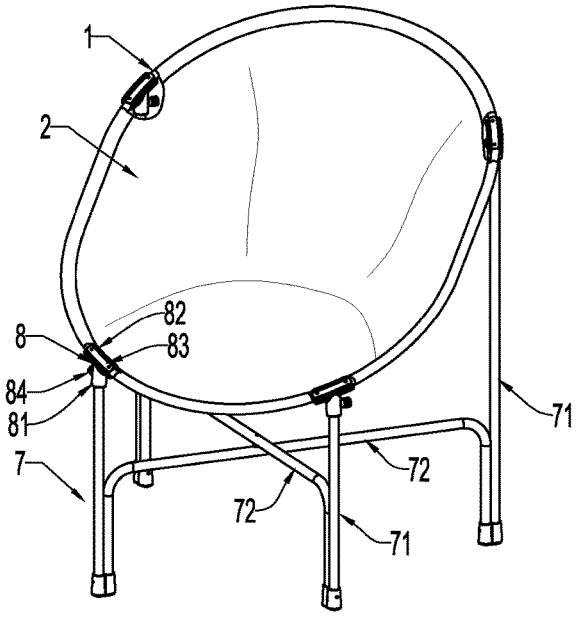
FIG. 2 shows a collapsible folding chair 3D schematic diagram.
Figure 3:
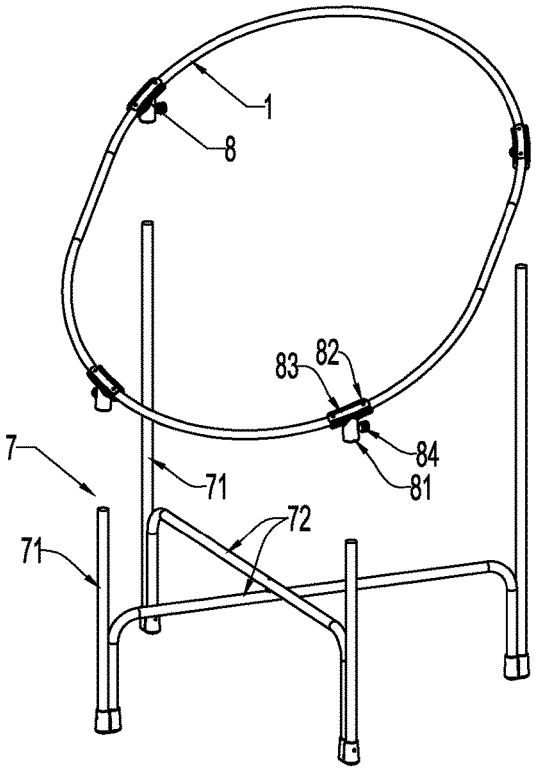
FIG. 3 shows a collapsible folding chair support frame 3D disassembled diagram.

The following is an introduction to the shape in FIG. 1:

In FIGS. 2 and 6, the seat ring is an oval shape, and the oval shape is similar to the round shape, only the oval is longer in the long axis direction. The advantage of the oval shape is that, while the width is limited to a certain size, it is still possible to provide a user's head with support; the oval shape is a basic shape, and can be developed into other structures.

Figure 7:
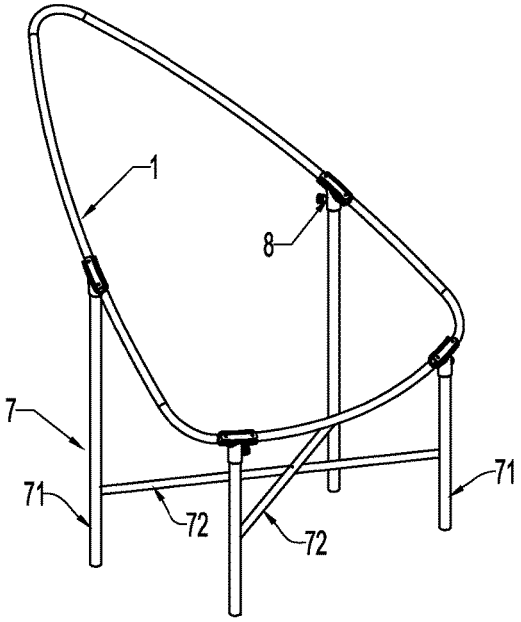
FIG. 7 shows a triangular seat ring folding chair support frame schematic diagram.

In FIG. 7, the seat ring 1 is formed by a triangle, a shape that not only saves materials, but is also aesthetically pleasing. The front part's relatively widely spaced legs provide more room for movement, and the back part, which sticks out, also happens to provide a relatively narrow head support, such that the seat ring 1 takes up the least space among all the different proposed shapes.

Figure 8:
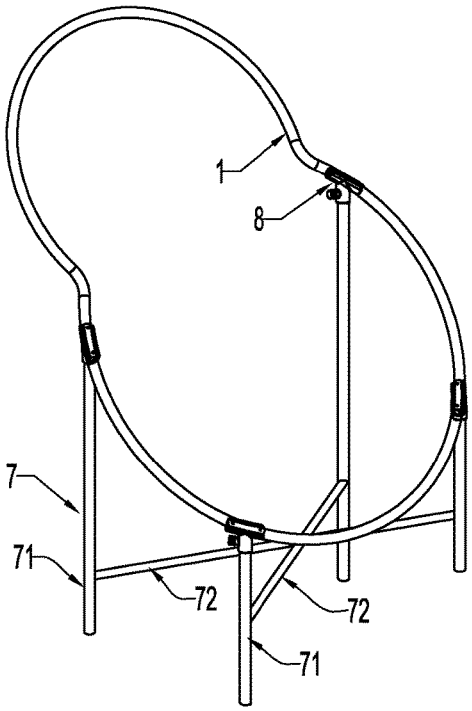
FIG. 8 shows a calabash-shaped seat ring folding chair support frame schematic diagram.

In FIG. 8, the seat ring 1 is a calabash shape; a similar design could be developed with a pear shape.

Figure 9:
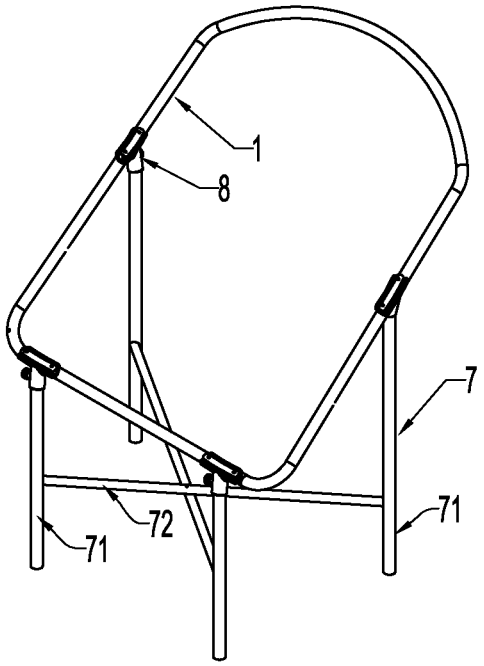
FIG. 9 shows a bread loaf-shaped seat ring folding chair support frame schematic diagram.

In FIG. 9, the seat ring 1 is a bread loaf shape, which has a rounded top and a squared bottom shape.

Figure 10:
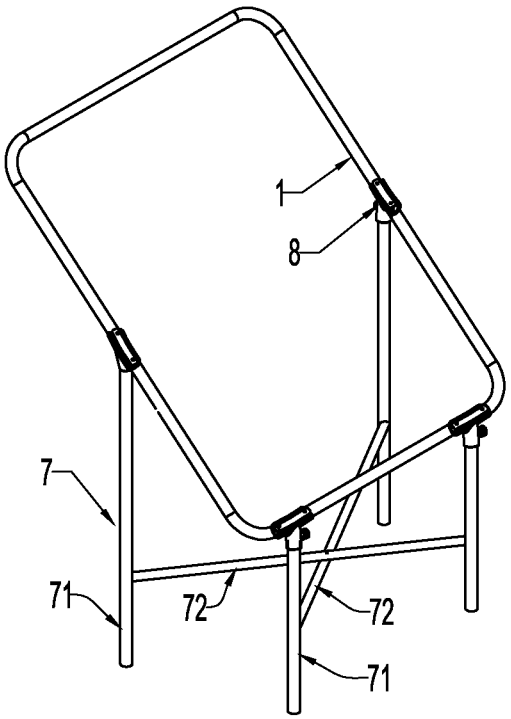
FIG. 10 shows a rectangle-shaped seat ring folding chair support frame schematic diagram.

In FIG. 10, the seat ring 1 is a rectangular shape, which can either be a long rectangular shape as shown, or can be a square shaped structure.

Figure 11:
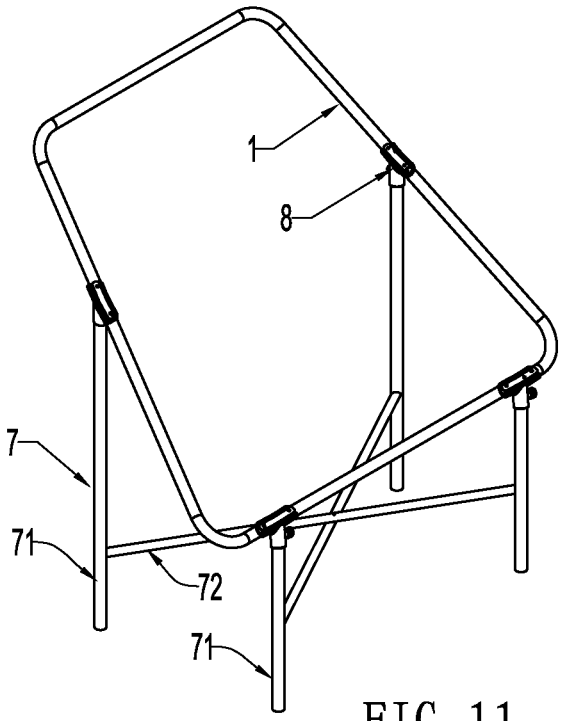
FIG. 11 shows a trapezoid-shaped seat ring folding chair support frame schematic diagram.

In FIG. 11, the seat ring is a trapezoid shape. This is based on the rectangle shape, but top is narrower, forming a different shape.

Figure 12:
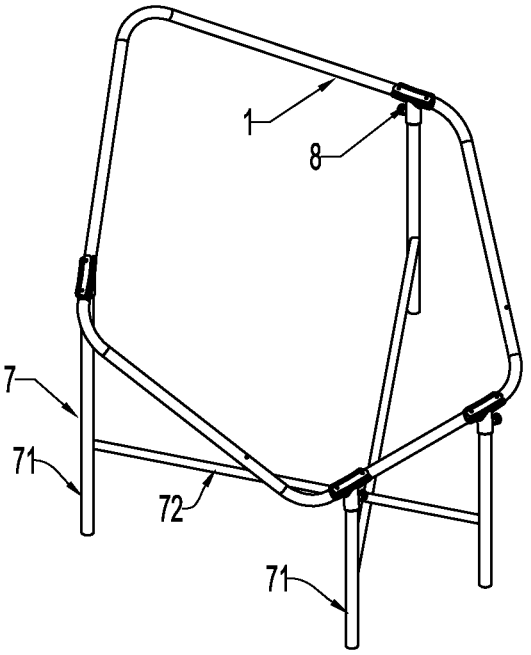
FIG. 12 shows a pentagon-shaped seat ring folding chair support frame schematic diagram.

In FIG. 12, seat ring 1 is a pentagon shape, like an elegantly shaped diamond.

Figure 13:
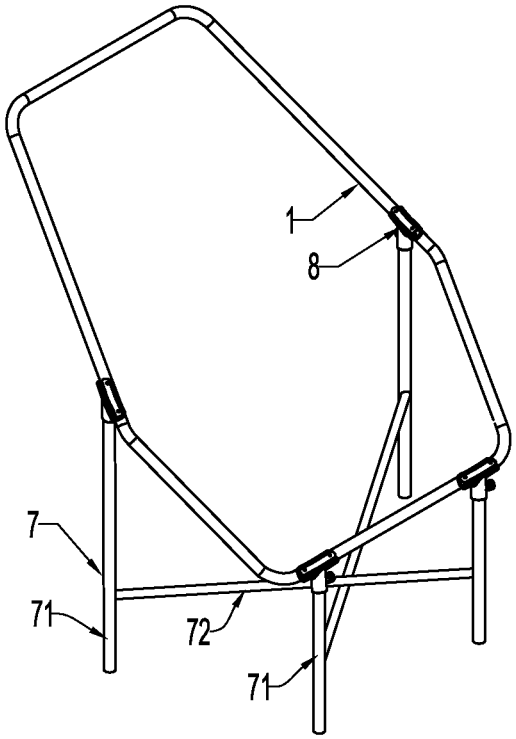
FIG. 13 shows a hexagon-shaped seat ring folding chair support frame schematic diagram.

In FIG. 13, the seat ring is a hexagonal shape. In the picture its six sides are not symmetrical. The bottom section is shortened to make the shape more aesthetically pleasing, though, of course, a perfect hexagonal structure is also possible.

Figure 14:
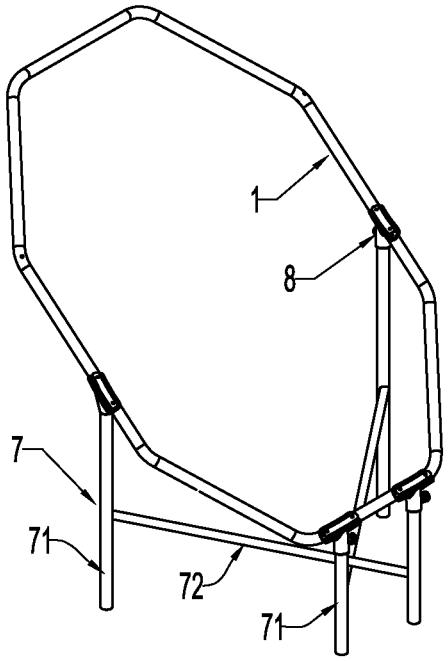
FIG. 14 shows an octagon-shaped seat ring folding chair support frame schematic diagram.

In FIG. 14, seat ring 1 is an octagonal shape, which is also to say that the seat ring can change from a triangle shape into a multi-sided shape, based on the shapes that need to be designed based on users' aesthetic and life requirements.

Figure 15:
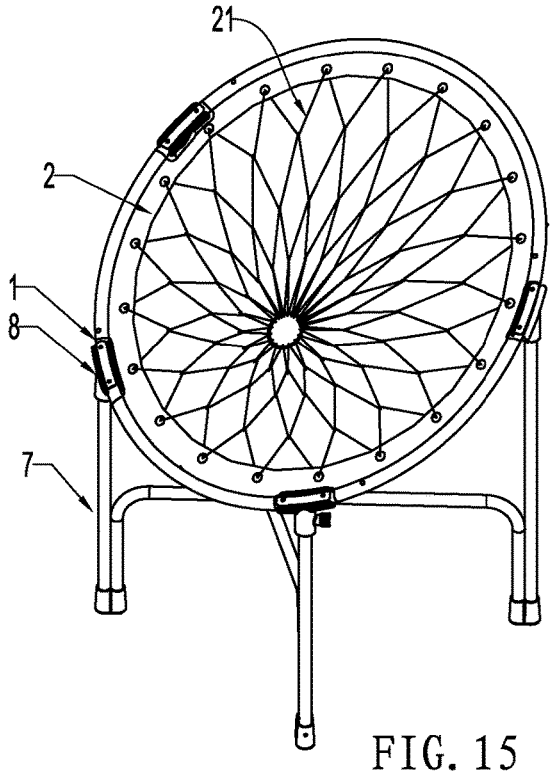
FIG. 15 shows an elastic cord seat rest fabric usage schematic diagram.
Figure 16:
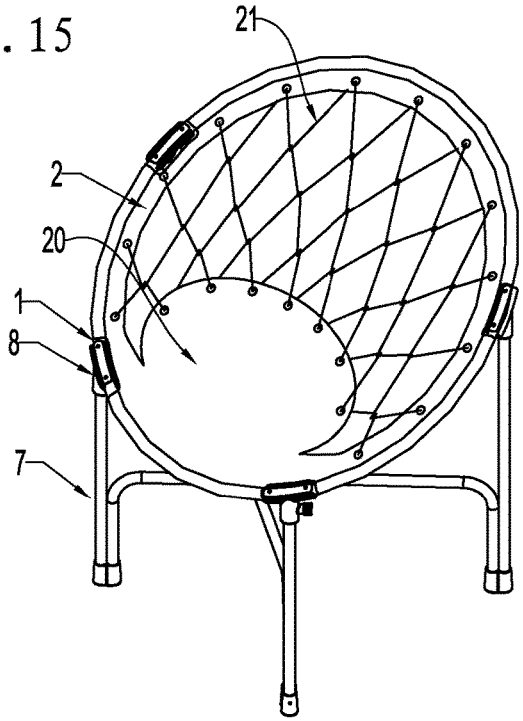
FIG. 16 shows an elastic cord seat rest fabric 2nd usage schematic diagram.
Figure 18:
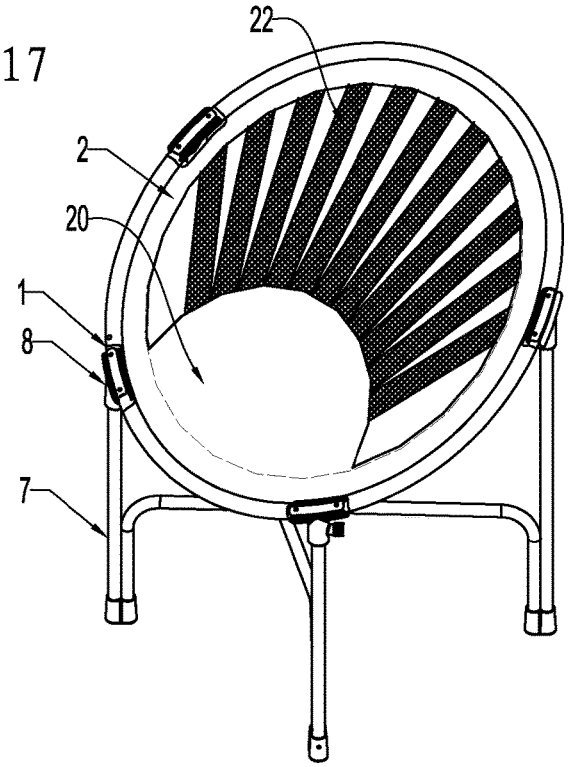
FIG. 18 shows an elastic belt seat rest fabric 4th usage schematic diagram.

In FIGS. 15, 16, and 18, the seat ring is a round shape. This is one of the basic shapes, and thus, processing will be simple.

On the foundation of the aforementioned different seat ring shapes, it is possible to provide a range of choices with regards to the seating fabric 2 attached to the seat ring 1 support, creating a cornucopia of patterns. Seating fabric 2 options are listed below:

In FIGS. 1 and 2, the seating fabric 2 is an Oxford fabric stitched into a continuous seat. This is also a currently existing and very common structure. The seat can also be made with stuffing, for example, with cotton insulating materials for winter use. Aside from this, the following structures are available:

See FIG. 15, for a pure elastic cord 21 threaded into a seating fabric. The threaded pattern can be in the shape of a sunflower, or a caltrop shape, rectangle, etc.

See FIG. 16, which is an elastic cord 21 and Oxford cloth combined into a seat, which has a seat section 20 using Oxford cloth that, after bearing weight will change shape only a little. This avoids the problem of having elastic cord tighten over the buttocks; the elastic cord 21 is threaded into a back rest forming an image that can be either a caltrop shape, or a radial pattern.

Figure 17:
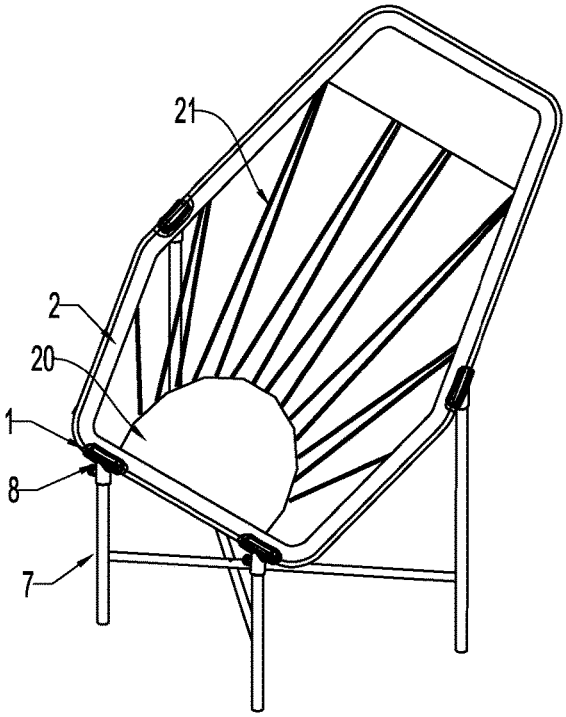
FIG. 17 shows an elastic cord seat rest fabric 3rd usage schematic diagram.

See FIG. 17, which is an elastic cord 21 and Oxford cloth combined into a seat section. As an additional option, elastic cord 21 can form a radial "sun ray" pattern.

See FIG. 18. Elastic belts 22 and Oxford cloth combine into a back rest, with the seat 20 made of Oxford cloth, and the elastic belts 22 forming a radial pattern, stitched between the seat 20 and the backrest.

Elastic cord or elastic belt, whether used alone or in combination with Oxford cloth to form a backrest, is in its static condition a flat plane; however, when a user sits on it, the user's weight will make the elastic cord 21 or elastic belt 22 change in shape, encompassing the back of the buttocks, and providing support for the shoulders and head. The above patterns for seating are suitable for any type of shape, including those depicted in FIG. 2 or 6 through 14, for example.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A collapsible folding chair, comprising:

a seat ring and folding legs, with a backrest fabric installed over the seat ring;

said seat ring being provided with four positioning pieces with downward facing sheath tubes, and a locking structure on each sheath tube;

said folding legs include four support rods and two horizontal bars;

said four support rods corresponding with the four positioning pieces, respectively;

two diagonally disposed instances of the support rods form a unit, wherein the diagonally disposed support rods are fixed together by a one of the horizontal bars to form one body;

wherein the unit is one of two units thusly formed, each of which units incorporates two of the support rods with one of the horizontal bars, wherein the two units are cross-hinged together so that they can pull together when folded up for storage with the seat ring; and wherein the positioning pieces on said seat ring are attached to top ends of respective instances of the four support rods by means of the sheath tubes of the respective positioning pieces, such that the seat ring and the support rods are linked together by the locking structures.

2. The collapsible folding chair of claim 1, wherein said support rods and a respective one of the horizontal bars are fixed together by means selected from the group of: two ends of the horizontal bars having curved segments, and each of these curved segments pressed against one of the support rods, and riveted in place with two rivets; the two ends of the horizontal bar are welded to the support rods; and each of the horizontal bars and the two diagonally disposed support rods formed of a single rod that is bent into shape.

3. The collapsible folding chair of claim 1, wherein each of the positioning pieces forms a T-shaped structure with the sheath tube longitudinally, vertically extending downward, and longitudinally horizontal brackets supporting the seat ring, wherein the seat ring is riveted to these brackets.

4. The collapsible folding chair of claim 3, wherein the positioning pieces' brackets have also been configured each with a brace, and the respective brace covers the seat ring where it is bracketed by the positioning piece; and wherein the rivets pass through the brace, seat ring, and brackets, such that the three are then riveted together.

5. The collapsible folding chair of claim 4, wherein the seat ring forms one of the following structures: circular; oval; rectangular; triangular; pentagonal; hexagonal; octagonal; trapezoidal; calabash-shaped; rounded top, or squared bottom bread loaf-shaped.

6. The collapsible folding chair of claim 1, wherein the seat ring forms one of the following structures: circular; oval; rectangular; triangular; pentagonal; hexagonal; octagonal; trapezoidal; calabash-shaped; rounded top, or squared bottom bread loaf-shaped.

7. The collapsible folding chair of claim 6 wherein the seat ring comprises one or more closed seams located at one or more of the positioning pieces' brackets, and wherein the one or more seams is connected with the brace by riveting with the bracket.

8. A The collapsible folding chair of claim 3, wherein the seat ring forms one of the following structures: circular; oval; rectangular; triangular; pentagonal; hexagonal; octagonal; trapezoidal; calabash-shaped; rounded top, or squared bottom bread loaf-shaped.

9. The collapsible folding chair of claim 3, wherein the seating fabric is shaped into one of the following structures: Oxford cloth stitched into the seat; an elastic cord planar weaved structure; elastic cord planar structure with weaved portion; or an elastic belt; or an elastic belt woven with Oxford cloth into the seating as a planar structure.

10. The collapsible folding chair of claim 1, wherein the positioning pieces' locking structure is one of the following: a bolt that is screwed into the positioning pieces' sheath tube, with an end of the bolt facing a center of the sheath tube, or a spring lock, with said spring lock fixed into a wall of the positioning pieces' sheath tube and wherein an end of the spring lock faces the sheath tube's center.

11. The collapsible folding chair of claim 3, wherein the positioning pieces' locking structure is one of the following: a bolt that is screwed into the positioning pieces' sheath tube, with an end of the bolt facing a center of the sheath tube, or a spring lock, with said spring lock fixed into a wall of the positioning pieces' sheath tube and wherein an end of the spring lock faces the sheath tube's center.

12. The collapsible folding chair of claim 4, wherein the positioning pieces' locking structure is one of the following: a bolt that is screwed into the positioning pieces' sheath tube, with an end of the bolt facing a center of the sheath tube, or a spring lock, with said spring lock fixed into a wall of the positioning pieces' sheath tube and wherein an end of the spring lock faces the sheath tube's center.

* * * * *